United States Patent [19]

Dysarz

[11] Patent Number: 4,552,498

[45] Date of Patent: Nov. 12, 1985

[54] PICKUP AND LAY-DOWN APPARATUS

[75] Inventor: Edward D. Dysarz, Houston, Tex.

[73] Assignee: Branham Industries, Inc., Conroe, Tex.

[21] Appl. No.: 490,731

[22] Filed: May 2, 1983

[51] Int. Cl.[4] ..... E21B 19/14

[52] U.S. Cl. ..... 414/22; 414/736; 414/741; 414/745; 414/763

[58] Field of Search ..... 414/736, 741, 745, 747, 414/22, 763, 771, 783, 784, 748

[56] References Cited

U.S. PATENT DOCUMENTS

| | | | |
|---|---|---|---|
| 3,613,905 | 10/1971 | Woolslayer et al. | 414/22 |
| 3,633,771 | 1/1972 | Woolslayer et al. | 414/22 |
| 3,655,071 | 4/1972 | Langowski et al. | 412/22 |
| 3,696,944 | 10/1972 | Campbell | 414/22 |
| 3,716,155 | 2/1973 | Woolslayer et al. | 414/786 |
| 4,076,130 | 2/1978 | Sumner | 414/747 X |
| 4,344,220 | 8/1982 | Sachot | 414/736 X |
| 4,426,182 | 1/1984 | Frias et al. | 414/22 |

OTHER PUBLICATIONS

MERECO Offshore Pickup and Laydown Machine—-Models 44 and 33 (undated).

Western Gear Corporation Pipe Master Land Pipe-racker (undated).

BC Manufacturing, Inc.—Various Pickup and Lay-down Machines including the Model 25 (undated).

Polar Frontier Drilling of Oslo, Norway—Photostatic Copies of Drawings of Pickup and Laydown Machines (undated).

The AC Company, Inc. Laydown and Pickup Machines (undated).

The Roto Trip System (RTS) Automatic Drill Pipe Handling System (undated).

*Primary Examiner*—Leslie J. Paperner

*Assistant Examiner*—Janice Krizek

*Attorney, Agent, or Firm*—Arnold, White & Durkee

[57] ABSTRACT

A pick-up and lay-down apparatus that will pick up drill pipes, casings, collars and riser pipes from pipe racks of a variety of different off-shore drilling installations, such as a drill ship, semi-submersible drill rig, jack-up drill rig, platform drill rig, etc., and set (lay-down) the pipes on the drill floor for easy access is disclosed. The apparatus also operates to transfer the pipe from the drill floor to the pipe rack. The pick-up and lay-down apparatus may use either hydraulic or electric motors for the primary power source to drive it. Rack and pinion systems are employed to move the various components of the apparatus during pick-up and transfer of the pipe. The system includes a moveable gantry beam; two moveable pick-up and lay-down carriages; one or more moveable troughs; and, two or more lifting and rotating arms. The apparatus could also be truck mounted for onshore operations.

17 Claims, 23 Drawing Figures

Fig. 5
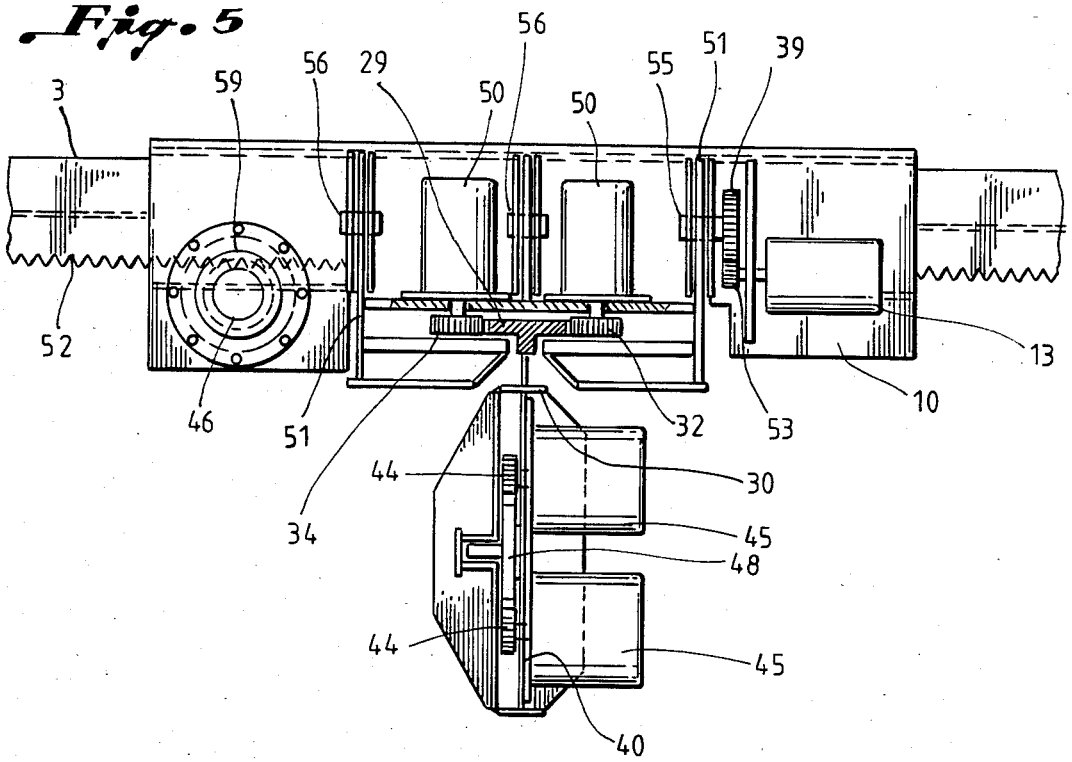
Fig. 13
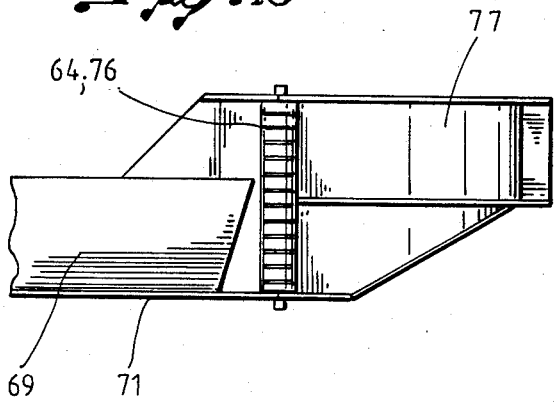
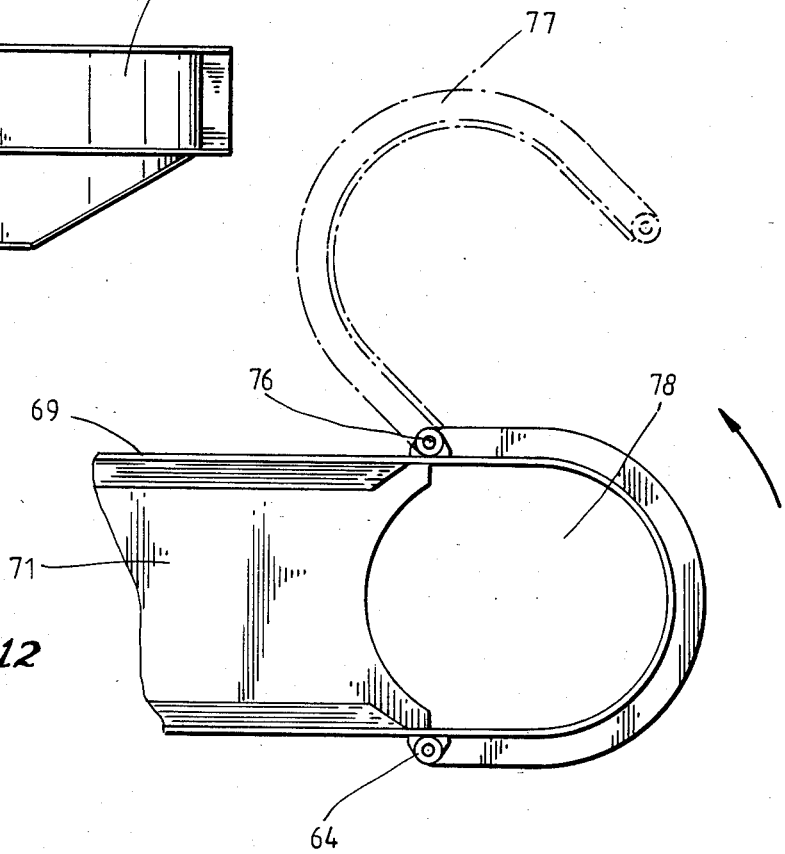
Fig. 12

Fig 14A
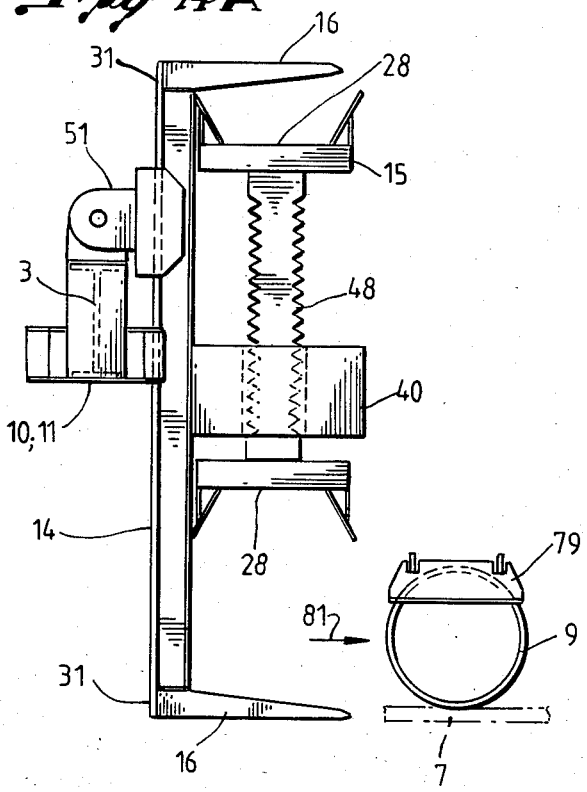
Fig. 14 B
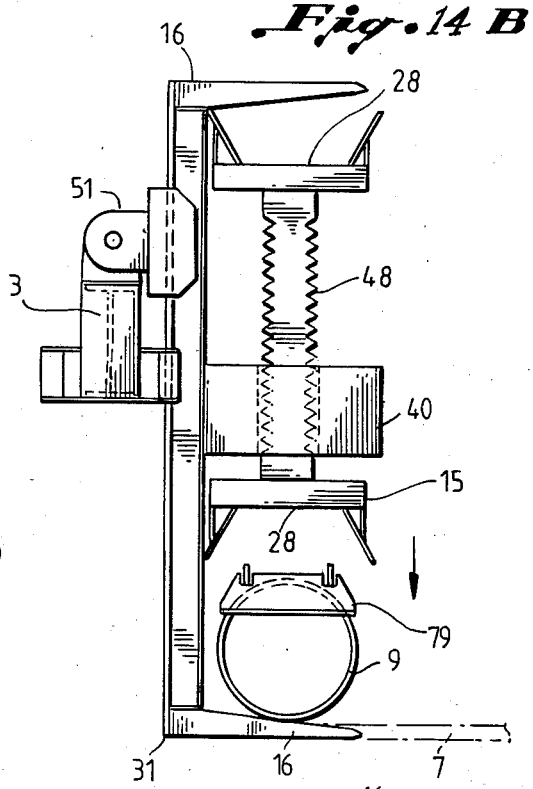
Fig. 14 C
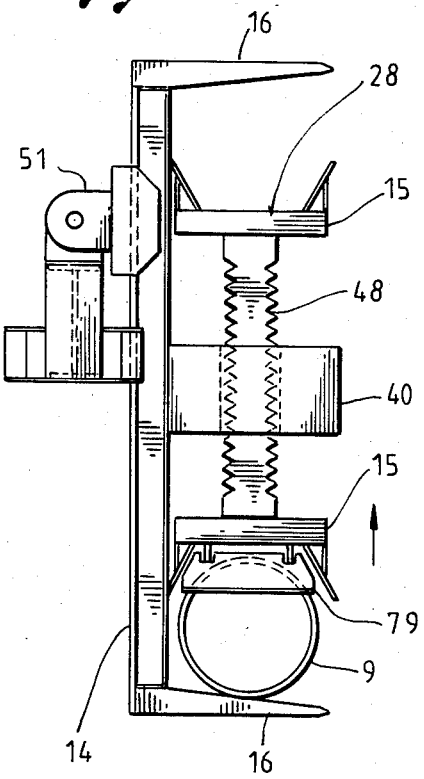
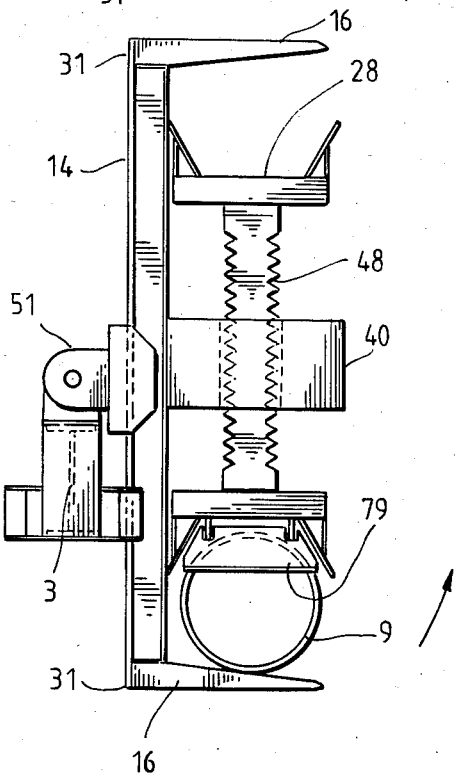
Fig. 14 D

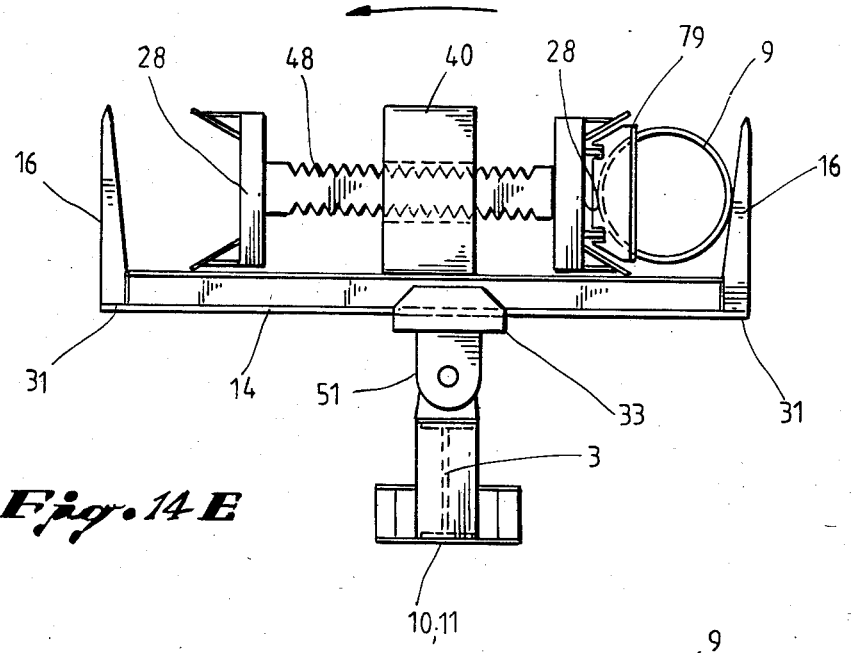
Fig. 14E
Fig. 14F
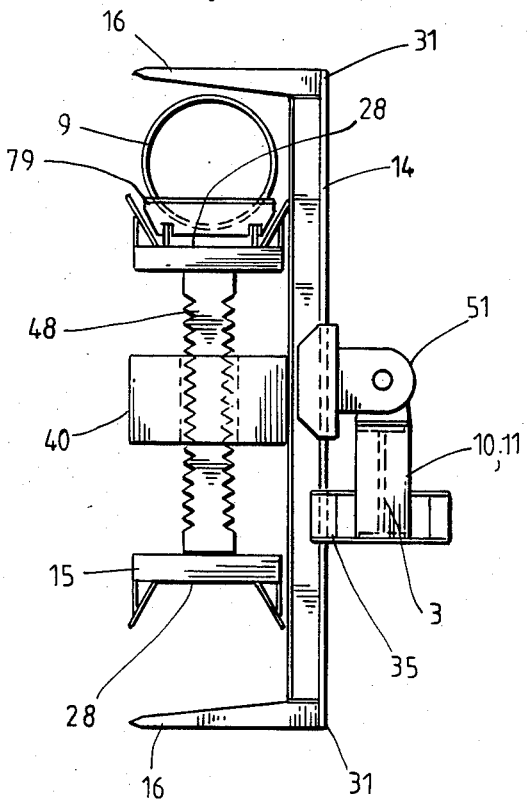
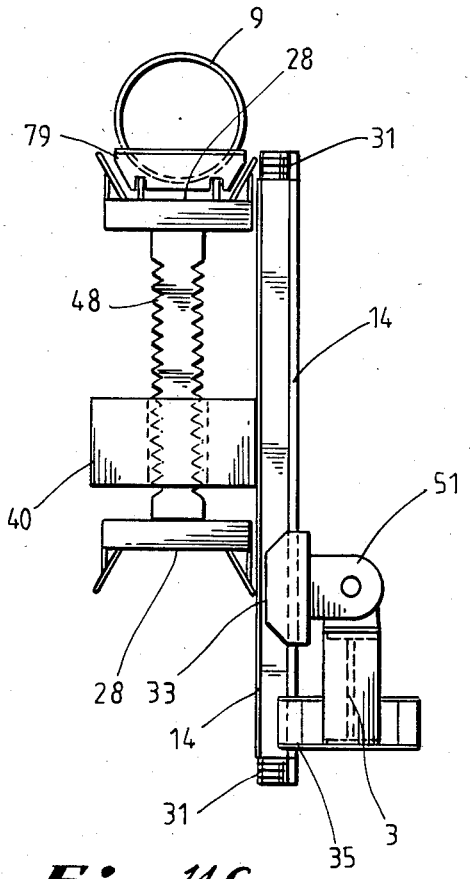
Fig. 14G

PICKUP AND LAY-DOWN APPARATUS

BACKGROUND OF THE INVENTION

The present invention relates to pipe handling systems for handling a variety of oil field tubular pipe, such as drill pipe, production tubing, well casing, and riser pipe. More particularly, the present invention relates to pick-up and lay-down systems for use in offshore drilling operations where pipe is picked up from a pipe rack, placed in a trough, and the trough and pipe moved to a position on the drill floor where the pipe may be removed from the trough.

There are several prior art methods of picking up and laying down drill pipes, casings, collars, and risers. The most common method, which is the only method on jack-up drill rigs and platform drill rigs, is also the most primitive and dangerous. A worker must first tie a sling around a bundle of pipe (the bundle will weigh up to 10 short tons) and then guide the pipe as it is lifted off of the pipe rack. To do this, a worker must stand on a stack of pipe which may be as high as ten feet, which in itself could be very dangerous.

When the pipe is raised above the pipe rack it is then swung over to a V-door ramp or dragway where another worker must grab the pipe bundle and guide it down in place on the ramp or dragway. Often, a worker is bumped around and injured when the crane swings the pipe out too far. After the pipe is set in the dragway, a cat line is tied to the end of the pipe and the pipe is pulled up the ramp to the drill rig floor by the combination of the cat line and an air tugger. This final operation often damages the pipe.

There are several different types of pick-up and lay-down machines being used on offshore operations, however, these prior art devices have been used with very limited success. One example of those offshore systems is the B C Manufacturing Co. Model 25 unit which is primarily designed for onshore operations, but has been used offshore on occasions.

The Model 25 requires a support cable to be attached at one end to the derrick of the drill rig. The other end of the cable is attached to a winch bolted to the pipe rack. A trough is provided for receiving the pipe, one pipe at a time. The pipe is rolled into the trough and the trough pulled along the support cable to the drill floor. Unfortunately, this system is unable to handle the heavier pipes, such as risers and longer casing pipe, because of the sag produced in the support cable.

Another type of pick-up and lay-down machine is the Mereco Model 44. The Model 44 operates to transfer drill pipes, casings, and risers to the drill floor. The Mereco Model 44 is stationary and requires a crane to load the pipe, casings and risers from the pipe rack to the trough. The trough and pipe is then lifted to the drill floor by a series of hydraulic rams. The Model 44 is capable of handling double and triple pipe groups at a time.

Western Gear also makes a prior art pick-up and lay-down machine for use on offshore operations. This unit is called the Pipe Racker. The Pipe Racker is stationary and requires a slot approximately 4 feet by 8 feet to be cut into the drill floor for installation. This type of modification is expensive, and most drilling contractors who consider using such a machine do not like to cut slots into their drill floors. The Pipe Racker is extremely expensive and complicated, involving many moving parts. Additionally, it can handle only certain kinds of pipe, for example, the lighter pipes, such as drill pipe and casing pipe, or the heavier pipes, such as the collars and riser pipes. A crane is required to load the pipe into a trough which is pushed up to the drill floor by a hydraulic system of rams.

SUMMARY OF THE INVENTION

In accordance with the present invention, a pick-up and lay-down apparatus for transferring tubular pipe from a pipe rack to the drill floor of a drilling ridge is disclosed. A gantry is provided that extends across the pipe rack. The gantry is adapted to move over the pipe rack to position the gantry above the pipe to be transferred.

Mounted on the gantry is a moveable trolley which is adapted to move longitudinally along the gantry. Mounted to the trolley is a pair of moveable spaced apart lifting arms. The spaced apart lifting arms are mounted to the trolley by a rotation means. Each of the spaced apart lifting arms are adapted to move independently of one another.

A moveable auxiliary lifting arm is mounted on each of the spaced apart lifting arms and is adapted for independent movement therebetween. The gantry and moveable trolley cooperate to position the lifting arms over the pipe to be transferred.

A fork assembly is rotatably mounted to the end of each spaced apart lifting arm. The fork assemblies are rotatable from a first position in which the spaced apart lifting arms may lower the forks to a level below the pipe on the pipe rack to a second position in which the forks are extended to beneath the pipe to be transferred.

A trough assembly is mounted to the auxiliary lifting arms for movement therewith. The auxiliary lifting arms move the trough in the direction of said forks to secure the pipe to be transferred between the forks and the trough assembly. The rotation means connecting the spaced apart lifting arms to the trolley rotate the lifting arms about the gantry from a first position in which the trough assembly is above the pipe to be transferred to a second position in which the pipe to be transferred is resting in the trough. The trough assembly is further extensible to supportably move the pipe to be transferred to the drilling rig floor.

Movement of the various lifting arms and rotation of the lifting arms about the gantry are accomplished through the use of rack and pinion gear assemblies. Connected to the end of the trough assembly is a lasso arrangement for use in facilitating the transfer of heavy riser pipe from the pipe rack to the drilling rig floor. As the heavy pipes are lifted from the trough by the drill rig elevator, the lasso engages the end of the pipe and permits the trough assembly to controllably contain the free end of the heavy pipe for positioning over the drilling rig floor.

In a narrower aspect of the invention, the spaced apart lifting arms include rotatable fork assemblies at either ends and the auxiliary lifting arms contain trough assemblies at both ends. In this manner, the lifting arm assemblies can operate to pick up pipe from either side of the gantry with the rotation means transferring the pipe from beneath a trough assembly to rest in the trough assembly on the opposite side of the gantry.

The independent movement of the various lifting arms enables the trough to be selectively positioned at a desired height and angle to facilitate the transfer of the pipe from the trough to the drilling rig floor.

The gantry includes a fixed support means at one end and a moveable support means at the opposite end. The moveable support means facilitates application of the invention to different length pipe racks and to accomodate movement of the drilling rig floor away from the pipe rack on certain drilling rig installations. The moveable support means is slidably mounted to said gantry thereby providing support at all times to a gantry crossbeam as the moveable support means is adjusted. The moveable support means further includes a drive means for propelling the gantry over the pipe rack.

BRIEF DESCRIPTION OF THE DRAWINGS

For a further understanding of the nature of the present invention, reference should be had to the following detailed description of the preferred embodiment thereof, taken in conjunction with the accompanying drawings, in which:

FIG. 5 is a more detailed top view of the support mechanism of FIG. 4;

FIG. 12 is a top plan view of a lasso attached to the trough of FIG. 10 for use in the transfer of large diameter pipe, such as risers and well casing;

FIG. 13 is a side view of the lasso shown in FIG. 12;

FIG. 14A is an illustration of the lifting arm, trough (dragway) and the fork assembly of the pipe handling mechanism of the present invention approaching a riser pipe positioned on a pipe rack;

FIG. 14B is an illustration of the fork pushed under the riser;

FIG. 14C is an illustration of the dragway descending on the riser or pipe;

FIG. 14D is an illustration of the riser or pipe being elevated;

FIG. 14E is an illustration of the assembly, including the riser or pipe, being rotated 180°;

FIG. 14F is an illustration of the riser or pipe after it is positioned inside of the trough;

FIG. 14G is an illustration of the riser or pipe in position for transfer to the drill rig floor;

Similar reference numerals refer to similar parts throughout the Figures.

DETAILED DESCRIPTION OF THE PREFERRED EMBODIMENT OF THE PRESENT INVENTION

The preferred embodiment of the pick-up and lay-down apparatus of the present invention may be used to move drill pipe, casing, risers, and collars from anywhere on the pipe rack to the drill floor, and vice versa, in one move without double handling of the pipe. This capability is accomplished by the method of picking the pipe up with a fork and trough combination where the trough is above the pipe and the fork below; transferring the pipe into the trough by rotating the entire combination 180°; rotating the fork assembly out of the way, elevating the trough, and then transfering the pipe onto the drill floor with the trough. Particularly important advantages of the present invention are preventing injuries to the workers on the pipe rack and preventing or reducing damage to the pipes, casings, risers, and collars during transfer. However, it will be appreciated that the present invention can be applied to pipe handling in pipe yards, and in some cases, even moving machinery on and off of the drill floor.

The preferred embodiment of the present invention is designed to be moved on and off of offshore drill rigs as a module, or mounted on a truck bed for land rigs.

Figure 1:
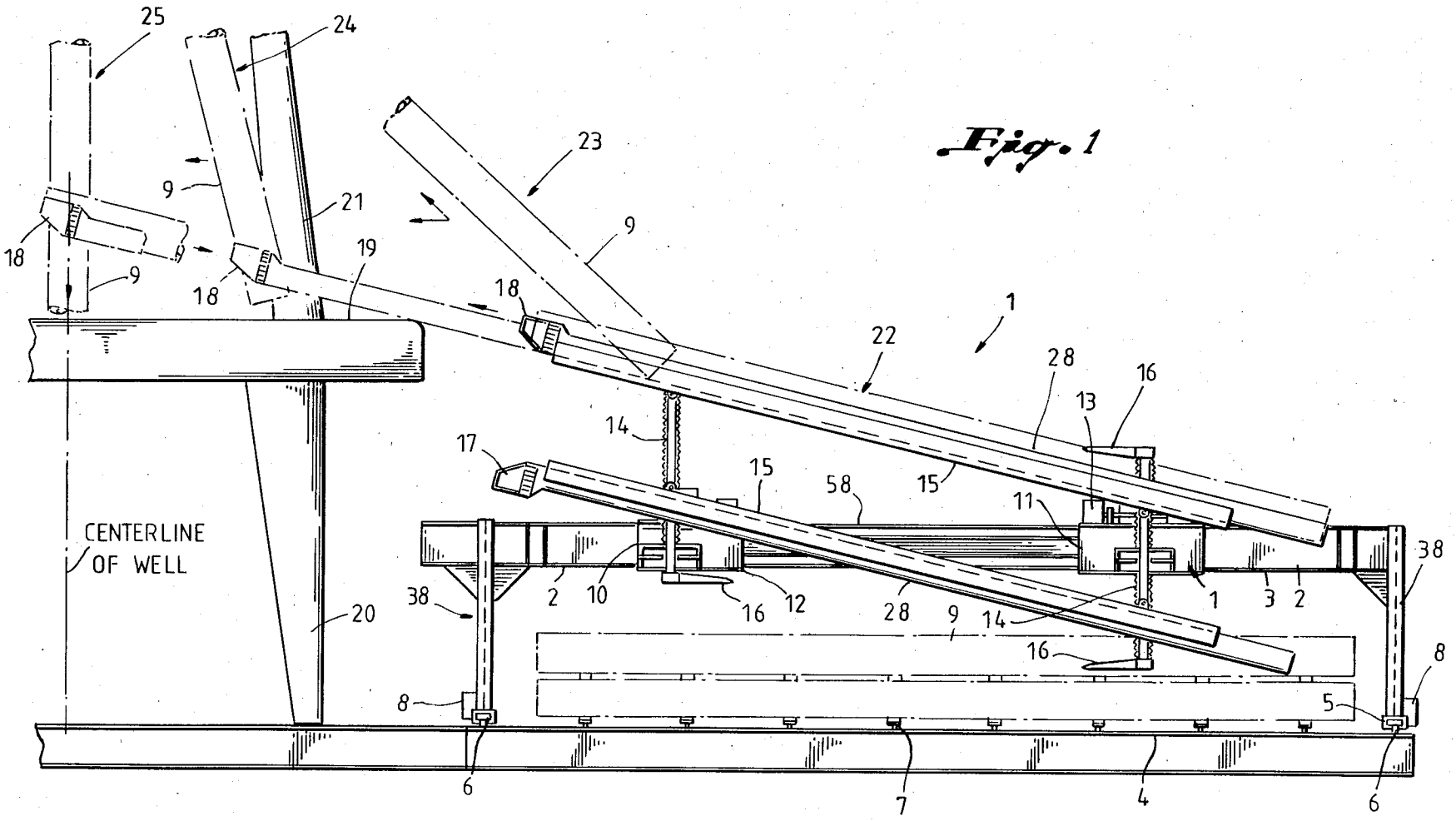
FIG. 1 is a side view of the preferred embodiment of the present invention illustrating the position of the pipe trough at various stages in a transfer of a riser pipe to the drill floor.

Referring to the Figures and first to FIG. 1, there is shown the preferred embodiment of the pick-up and lay-down apparatus 1 of the present invention. The apparatus 1 is mounted on a suitable gantry beam 2 which in turn is supported at its ends by support means 38 (see FIGS. 16 and 17). The support means 38 are suitably attached to a skid means 5 which rides on a skid rail 6. The skid rail 6 is mounted on a deck 4, or other supporting structure. The pipe rack support beams 7 are also mounted on the deck 4. The pipe rack beams 7 support the risers 9 or drill pipe or casings as shown. The gantry 2 is moved along the skid rails 6 by means of a rack and pinion (not shown) being driven by a hydraulic or electric motor 8.

The apparatus 1 includes a trolley unit 12 which consists of a propulsion unit 10 and a non-propulsion unit 11, both connected to a pinion. The trolley unit 12 contains the elements that support and move the two loading arms 14 up and down, and also to rotate the loading arms and attached elements 180° about the gantry beam 2. The loading arms 14 support the trough frame 15 and the forks 16. The trough frames 15 support the troughs 28, which in turn, support the drill pipe or risers 9. At the end of each trough 28 is a lasso 18 that catches pipes, casings and risers as they are lifted out of the trough 28 by the drill rig elevator.

The workings of the lasso 18 may be seen in FIG. 1. At position 22 the riser pipe 9 is shown ready for transfer to the drill rig floor. At position 23 the riser pipe 9 is being dragged from the trough 28. At position 24 the riser pipe 9 has been captured by the lasso 18 and its horizontal movements controlled thereby. At position 25 the riser pipe 9 has been moved to vertical and is centered over the drill floor 19. At this position, the lasso 18 may be opened and the trough 28 withdrawn to the position 22.

Figure 2:
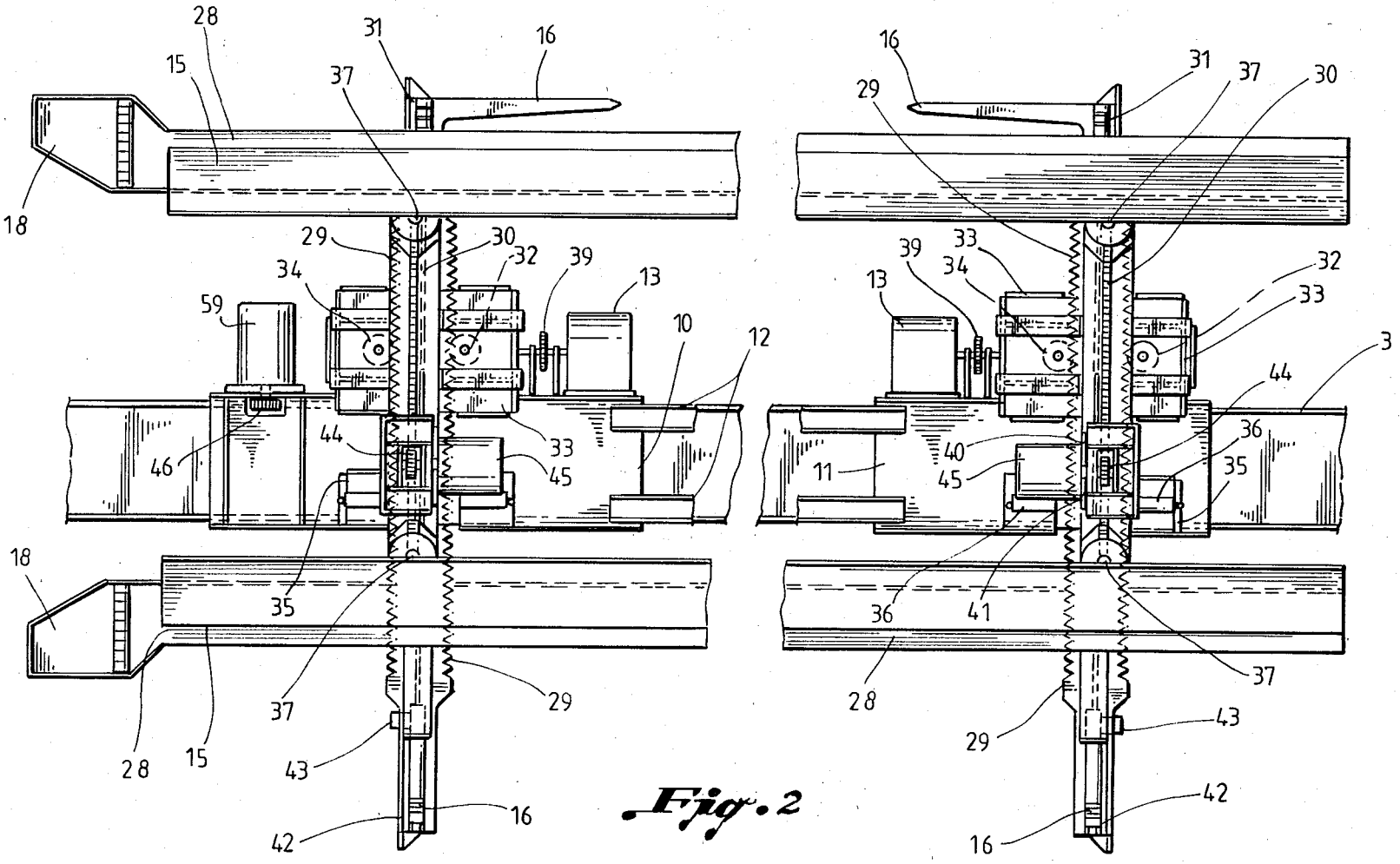
FIG. 2 is a detailed enlarged side view of the pipe handling components of the embodiment shown in FIG. 1.

Referring now to FIG. 2, there is shown a detailed enlarged view of the pick-up and lay-down apparatus 1 shown in FIG. 1. The trough frames 15 and troughs 28 are connected to loading arms 14 by means of a sliding pin 37 with pad eyes 47 (see FIG. 3). The loading arms 14 are made up of a rack plate 29, a web plate 49 and a face plate 30. The loading arms 14 are moved in a vertical manner by means of pinions 32 and 34, driven by motors 50, which react on rack plate 29. This causes loading arms 14 to move up and down. When loading arms 14 are moving up and down and when pipes are being pulled from trough 28, the loading arms 14 are held in place by a moveable guide 35. Guide 35 is moved into or out of the guiding position by a hydraulic or electric motor 36.

At each end of loading arms 14 is a single prong fork 16 which is attached to loading arms 14 by a hinge means 31. Hinge 31 enables fork 16 to be moved out of the way when not in use or when loading arms 14 are being lowered between stanchions separating the stacked pipes on the pipe rack 7. Forks 16 are rotated out of the way by means of a motor or actuator 43. The loading arms 14 are rotated by means of rotation motors 13, and if necessary, through a gear box 39. When loading arms 14 are rotated they are held in place by guides 33.

The whole trolley assembly 12 is moved fore and aft by means of pinion 46 driven by a motor 59. The pinion reacts on a rack 52 suitably located on the gantry beam 3.

Figure 3:
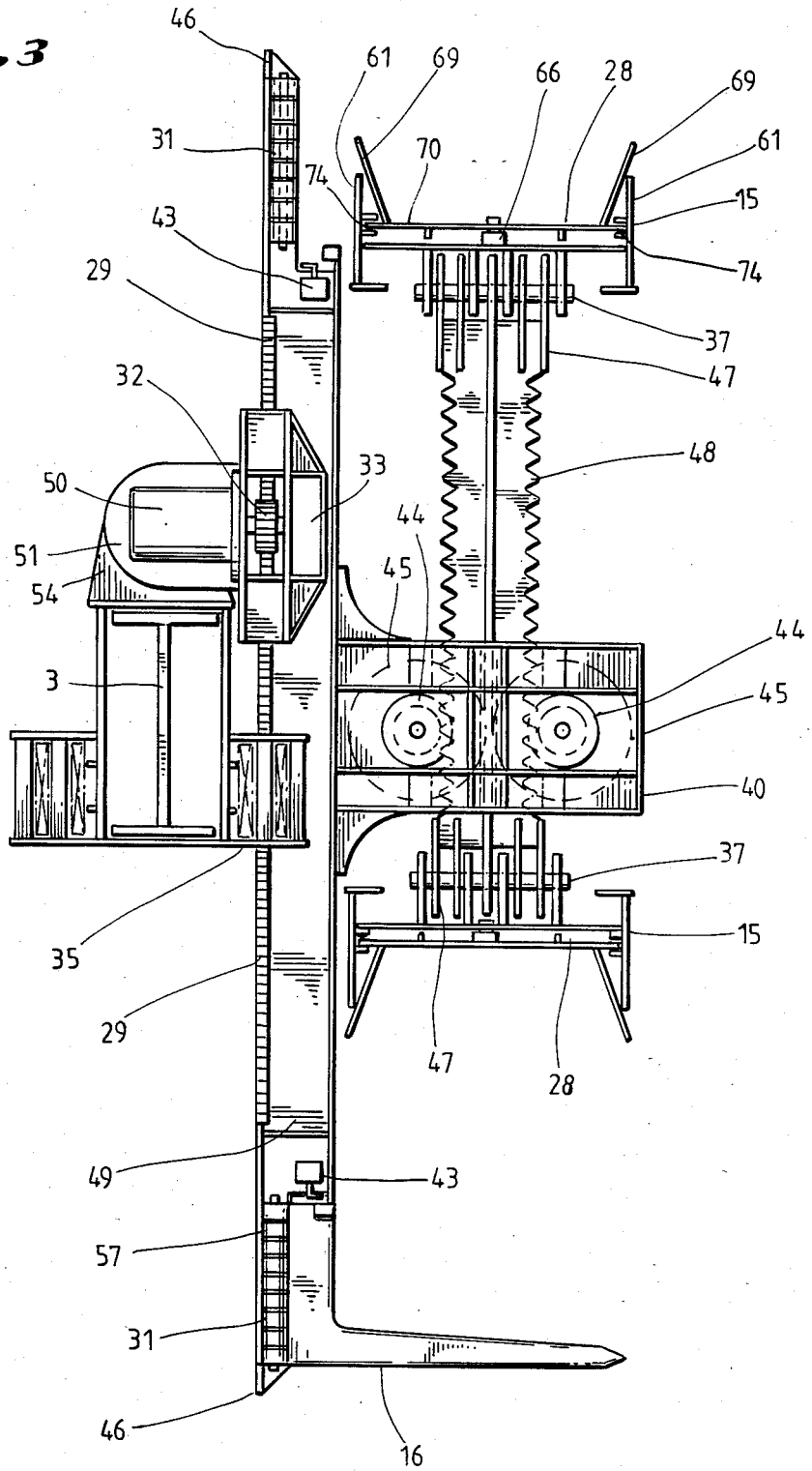
FIG. 3 is a detailed enlarged end view of the pipe handling components shown in FIG. 2.

Referring now to FIG. 3, there is shown an elevation of one of the loading arms 14. The loading arm 14 is moved up and down by gear 32 on rack 29. Gear 32 is turned by motor 50 which is pivotally mounted on trolley 10, 11. Each loading arm 14 is held in place by guide 33 which guides the arm and also holds motor 50 in place on rack 29. At both ends of loading arm 14 is a wedge 46 which is used to pry stacked pipes apart so that the forks 16 can be placed below and turned under the pipes for lifting.

The trough 28 is shown within the trough frame 15, which in turn, is mounted to the lifing arm rack 48 by pin 37 and plate 47. The trough 28 is constructed of a bottom plate 70 which rides in guide slots 74 formed on the inside surfaces side pieces 61 of trough frame 15. Inclined side plates 69 are welded to the bottom plate 70 to provide side support for any pipe contained in the trough 28. A rack 66 is connected to the under side of plate 70 at the center of the trough 28. The rack provides the means to move the trough 28 in frame 15.

FIG. 3 illustrates a dual arrangement for the trough assemblies 15, 28, one located at each end of a rack or auxiliary lifting arm 48. Rack 48 is coupled to a pair of pinion gears 44 that are driven by motors 45. With this arrangement, not only are the lifting arms 14 capable of movement up and down, but independent of that movement, the troughs 28 may also be moved in a vertical direction. As shown in FIGS. 1 and 2, the troughs 28 are supported at each end by identical lifting arm 14 mechanisms. Each lifting arm 14 assembly includes the rack 48, pinion gear 44 and motor 45 which act independently of the identical elements in the other lifting arm assembly. In this manner, the troughs may be elevated in the manner as shown in FIG. 1 or moved to a horizontal position as shown in FIG. 2.

Figure 4:
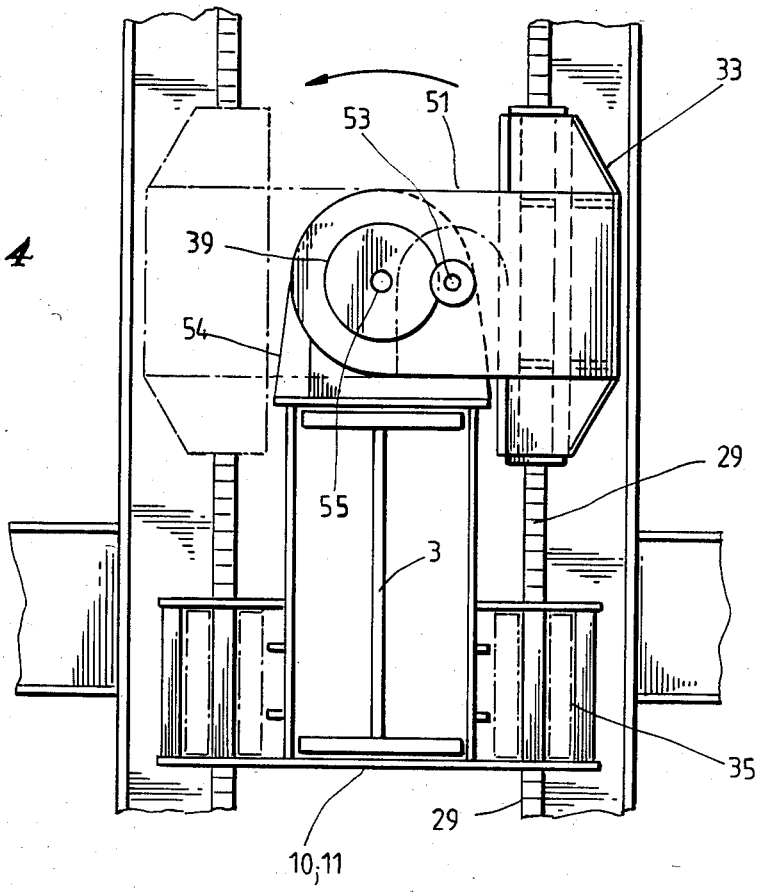
FIG. 4 is an enlarged partial view of the support mechanism which rotates the pipe handling components of FIG. 2 180° to position the pipe for transfer to the drill rig floor.

Turning now to FIGS. 4 and 5 there is shown two enlarged views of the pivot device of the present invention which rotates the lifting arm and trough assemblies 180° so that the pipe may be positioned in a trough 28 as shown in FIG. 1. Trolley unit 12 is shown on gantry beam 3. Pivot foundation 54 is suitably attached to trolley units 10 and 11. Pivot plate 51 is attached to pivot foundation 54 by means of pivot shafts 55 and 56. Pivot plate 51 is suitably attached to guide means 33. Lower guide 35 is suitably attached to trolley 10 and 11.

FIG. 5 illustrates the drive mechanism for moving the trolley unit 12 along the gantry 3 and for rotating the lifting arm assemblies in the 180° arc about the gantry 3. The trolley unit 12 is powered up and down gantry beam 3 by trolley unit 10. Trolley 10 is propelled on rack 52 by means of pinion 46 which is driven by motor 59. Motor 59 is suitably attached to trolley 10. The only difference between trolley 10 and 11 is the propulsion system 59 and 46. As stated previously, the pivot foundation 54 is suitably attached to the top of trolley 10 and 11 and is further attached to pivot plate 51 by means of pivot pins 55 and 56. The guide unit 33 is rotated by motor 13 which is suitably attached to trolley 10 and 11. Motor 13 turns gear 53 which also turns gear 39 or another suitable transmission. Gear 39 turns pivot shaft 55. Pivot plate 51 is suitably attached to pivot drive shaft 55 which supports and turns guide unit 33. The motors 50 that raise and lower lifting arms 14 are suitably attached to guide unit 33 so that when guide unit 33 pivots, motors 50 also pivot.

Attached to lifting arms 14 are outer guides 40 that guide rack or auxiliary lifting arms 48. Also suitably attached to outer guides 40 are motors 45 that cause pinions 44 to turn and thereby raise and lower auxiliary lifting arms 48.

Referring once again to FIG. 3, there is shown a view of the fork 16 and hinge 31. Fork 16 is mounted to loading arm 14 by hinge 31 and hinge pin 57. The fork 16 is rotated by actuator 43 or some other suitable means. Fork 16 rotates out of the way in order to insert the loading arms 14 between the pipe rack stanchions that separate pipe stacked on the pipe rack. If the pipes are not separated, the wedger 46 will separate the pipe far enough to permit the lifting arm to carry the forks below the pipe where they may be pivoted by actuator 43 to the lifting position below the pipe.

Figure 9:
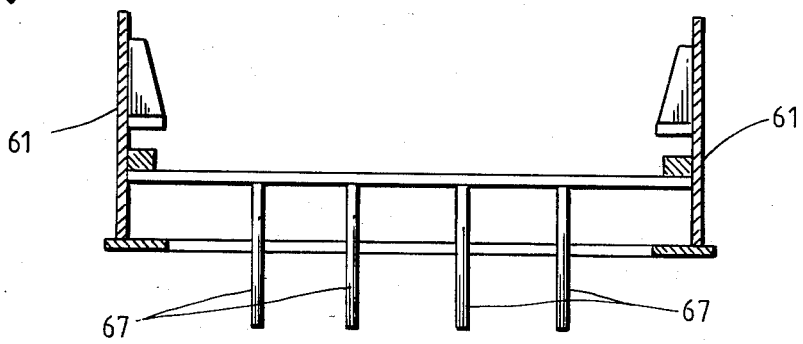
FIG. 9 is an end view of the section AA taken through FIG. 7.

Turning now to FIG. 9, which details the trough frame 15, the trough frame holds and allows the trough 28 to slide back and forth. The trough frame 15 has a wall plate 61 on each side with a flange 60 on the bottom for stiffness. The wall plates 61 each have two slots 62 cut into them to allow the forks 16 to land on the drill pipes and hold them in place. The trough frame 15 also has a motor 63 suitably attached. The motor 63 has a pinion 65 at one end that turns and causes the rack 66 and hence the trough 28 to move back and forth in the trough frame 15.

Figure 7:
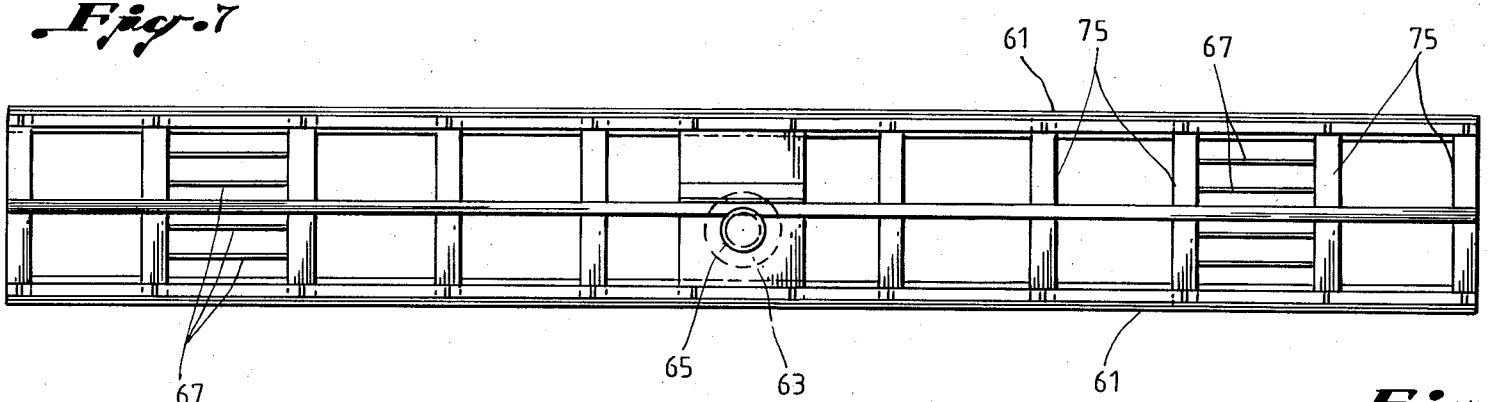
FIG. 7 is a top view of the trough frame of FIG. 6.
Figure 6:
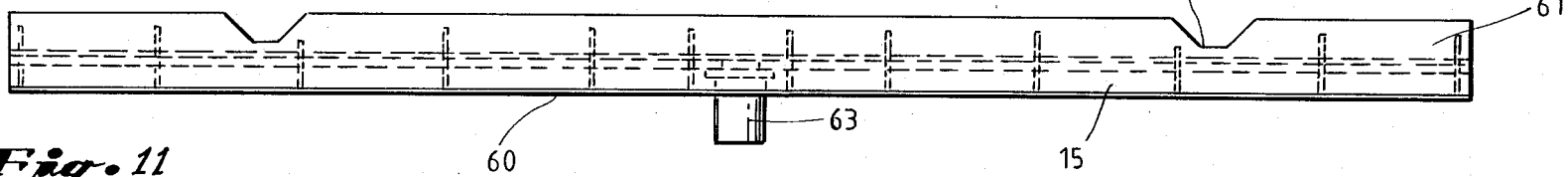
FIG. 6 is a side view of the trough frame.

FIG. 7 shows a top view of the trough frame 15. The trough frame sides 61 are suitably connected together by beams 75. The motor 63 and pinion 65 are attached to the trough frame 15. The slotted plates 67 are attached to trough frame 15, and are used to connect the sliding pin 37 (FIG. 3) which, in turn, is connected to the pad eyes 47.

Figure 8:
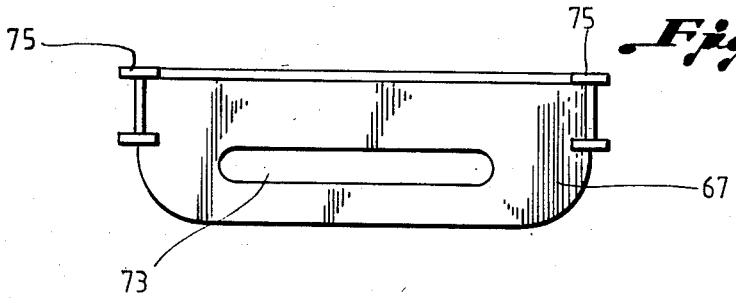
FIG. 8 is a view of the slotted plates illustrated in FIG. 7.

FIG. 8 shows a detail of a slotted plate 67 containing a slot 73. The slotted plate 67 with the slot 73 is required to compensate for the change in dimension from one lifting arm 14 to the other when the angle of the trough frame to horizontal is changed. FIG. 9 shows a sectional view of how the slotted plates 67 are located in the trough frame 15.

Figure 11:
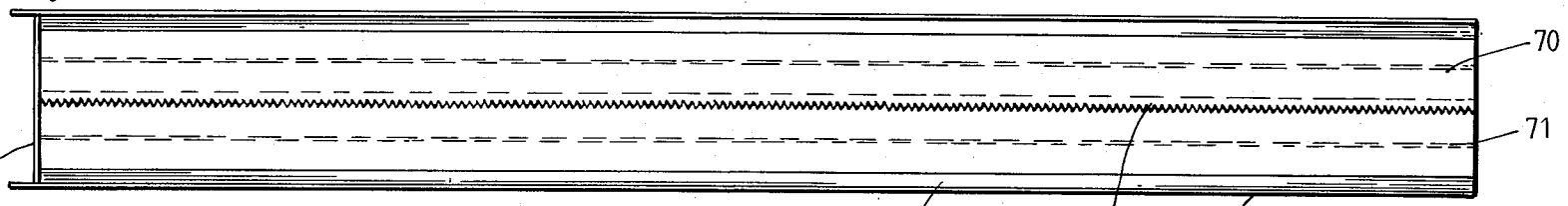
FIG. 11 is a top view of the trough of FIG. 10.
Figure 10:
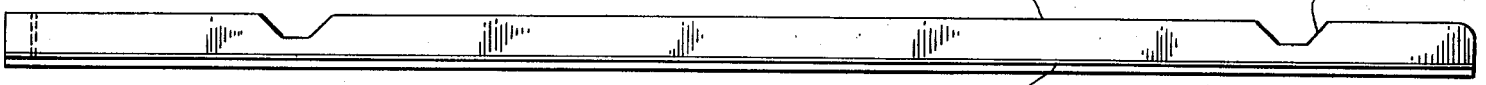
FIG. 10 is a side view of the pipe trough.

FIGS. 10 and 11 illustrate the trough 28. The trough 28 has two walls 69 with two slots 68 in each wall to allow the forks 16 to press and hold the drill pipes. The trough 28 also includes a bottom 71 which may also be covered with wood 70 (not shown). Underneath the bottom plate 71 is the rack 66 which causes the trough 28 to move back and forth in the trough frame 15 (see FIG. 3). The trough also has a back plate 72 to prevent the drill pipe, casing, or risers from sliding off of the trough 28 when it is at an angle to the horizontal.

Referring now to FIGS. 12 and 13, there is shown a detail of the riser and casing lasso 18. The lasso 18 is used to control the heavy casings and risers from swinging free when the risers are lifted up. The lasso 18 has a lasso ring 77 that has a suitable hinge 76 at one end and a suitable latch 64 at the other end. The center of the lasso 18 has an opening 78 to allow the casings and risers to pass through. The lasso 18 may not be required for light drill pipe.

Turning now to FIGS. 14A–14G, there is illustrated the method of operation of the present invention to pick up a riser pipe from the pipe rack and position the pipe for transfer to the drilling floor. FIG. 14A shows the riser 9 with a dolly 79 suitably attached to the riser in an inverted position. The dolly 79 could also be part of the trough 28 so that it would not have to be added or removed when riser 9 is used. In most cases, the dolly 79 is not even required. Although riser pipes are shown, it should also be noted that casings and drill pipes will be lifted in the same manner, only without the dolly 79. The riser 9 is shown on the pipe rack 7. The gantry 2 moves in the direction of the riser and by means of motors 8 mounted on the support means 38. The fork 16 is extended and moves toward the riser 9 so that it comes under the riser 9 as shown in FIG. 14B.

When the fork 16 is under the riser 9, the gantry 2 stops moving and the trough 28 and trough frame 15 are lowered to rest on top of the riser 9 and the dolly 79. When the trough is lowered to the riser, the riser 9 is firmly locked between the sets of forks 16 and the trough 28. When the riser 9 (or casing or drill pipes) are firmly locked in place between the forks 16 and the trough 28, the whole assembly is raised by motors 50 and pinions 32 acting on rack 29 to a position where riser 9 is near the pivot plate 51 as shown in FIG. 14D. Positioning riser 9 near pivot plate 51 reduces the lever arm when rotating the riser pipe and lifting arm assemblies through the 180° arc.

When the riser 9 is at the proper height, the whole unit is rotated 180° as shown in FIG. 14E. The rotation is accomplished by means of motor 13 turning gears 53 and 39. When the rotation is complete, FIG. 14F, the riser pipe is now lying in the trough 28 ready to be pushed up to the drill floor. The forks 16 are turned away to become parallel to the riser 9 length. After the forks 16 have been turned away, the trough 28 and riser 9 are further raised by motors 45, pinions 44, and auxiliary lifting arms 48 to the proper height and angle.

It should be pointed out that in some cases the risers, drill pipe, or casings will be stacked close together with only stanchions therebetween. In order to place forks 16 under the riser 9, the forks 16 must be turned parallel to the risers, and lowered to a position below the riser. There, the forks 16 are rotated 90° to a position under the risers 9 as shown in FIG. 14B. In a similar manner, drill pipe, collars and casings may be picked by the lifting arms. However, stanchions may not be provided between the pipes and the wedge at the end of the lifting arm will be required to separate the pipe as the lifting arms are lowered.

The embodiment shown in FIG. 1 is mostly for semi-submersible drill rigs, drill ships and drill barges where riser pipes are required and the pick-up and lay-down apparatus is a permanent part of the rig.

The present invention may also be used in other drilling rigs that require additional features to the embodiment shown in FIG. 1—jack-up drilling rigs and platform drilling rigs.

A jack up drill rig and a platform drill rig have two major differences from semi-submersibles, drill ships and drill barges. On a semi-submersible, a drill ship or a drill barge, the drill floor is stationary relative to the pipe rack, and riser pipes are required. On a jack-up drill rig and a platform drill rig, the drill floor changes locations relative to the pipe rack both transversely, and fore and aft. Riser pipes are not required on a jack-up or platform drilling rig. A third difference is that a jack-up drill rig and a platform drill rig is set on the sea floor or a stable platform that is set on the sea floor, and therefore are very stable and do not move. A semi-submersible, drill ship, or drill barge float and therefore move in the waves. For jack-up or platform drill rigs, a lasso 18 is not required, nor is a rack and pinion drive to move the gantry tranversely. Jack-up or platform drill rigs do require that the machine 1 follow the drill floor as the drill floor 86 moves transversely, or fore and aft.

When the present invention is used in connection with jack-up or platform drill rigs, there is no need to provide two troughs 28 on each lifting arm 14. The use of two troughs enable the pick-up and lay-down apparatus 1 shown in FIG. 1 to operate from both sides of the gantry 3. This operation is not necessarily needed in platform drilling operations, and accordingly, one of the troughs 28 can be removed. However, the operations of the lifting arm 14 and trough 28 is the same as illustrated in FIGS. 14A–14G. That is, the lifting arm 14 is lowered so that the forks 16 can be positioned below the pipe. The trough 28 is then lowered down to secure the pipe between the forks and the trough 28. The entire unit is then rotated through a 180° arc so that the pipe is now laying in the trough. The forks 16 are then retracted and the trough extended to the drill rig floor. Depending on where the pipe was picked up, the gantry 3 and lifting mechanisms may have to be moved with respect to the drill floor to a point where the trough can transfer the pipe to the drill floor where the pipe is needed.

Figure 15:
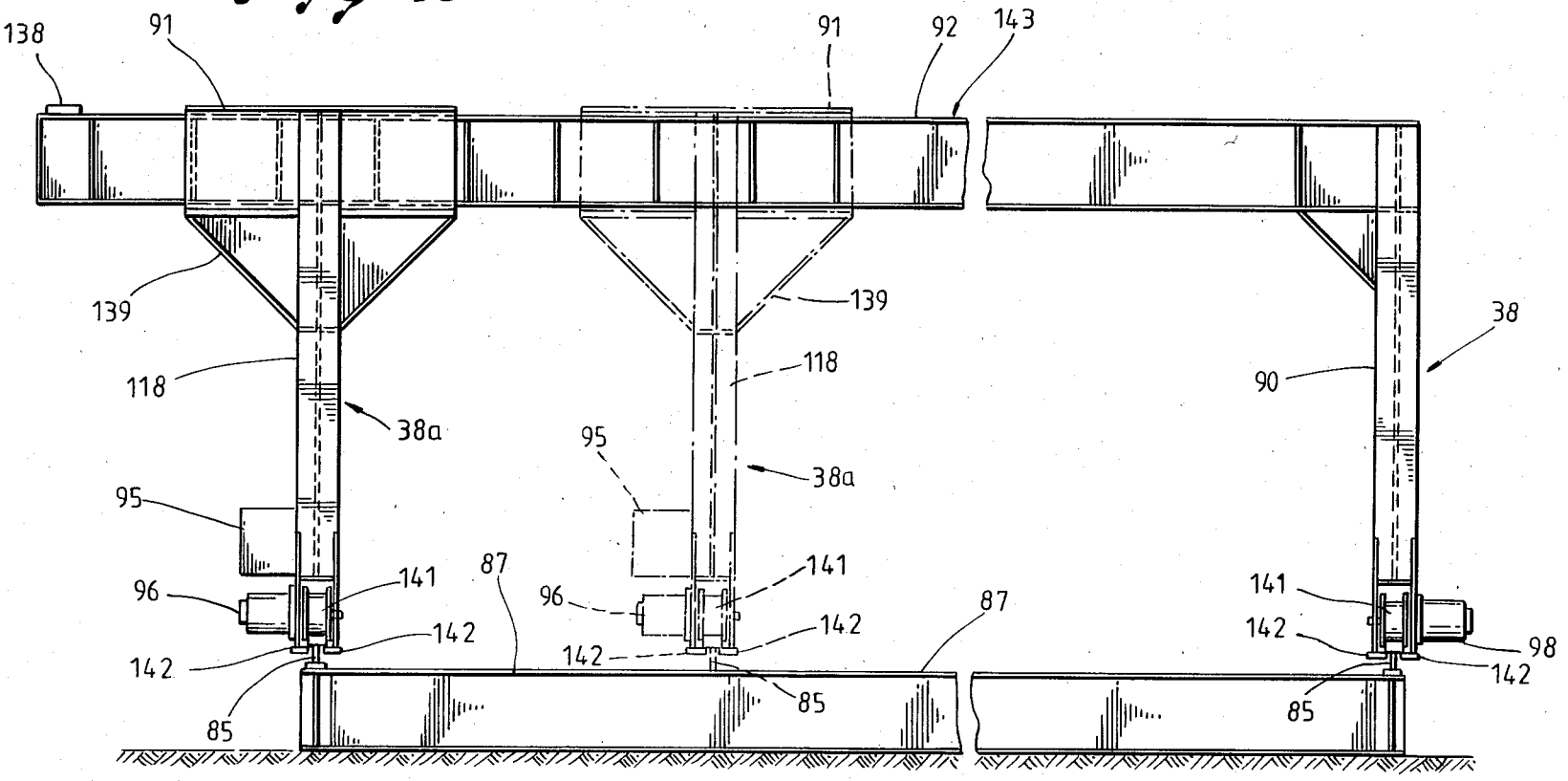
FIG. 15 is a side view of the adjustable length gantry on which the pipe handling mechanism of the present invention is supported.
Figure 17:
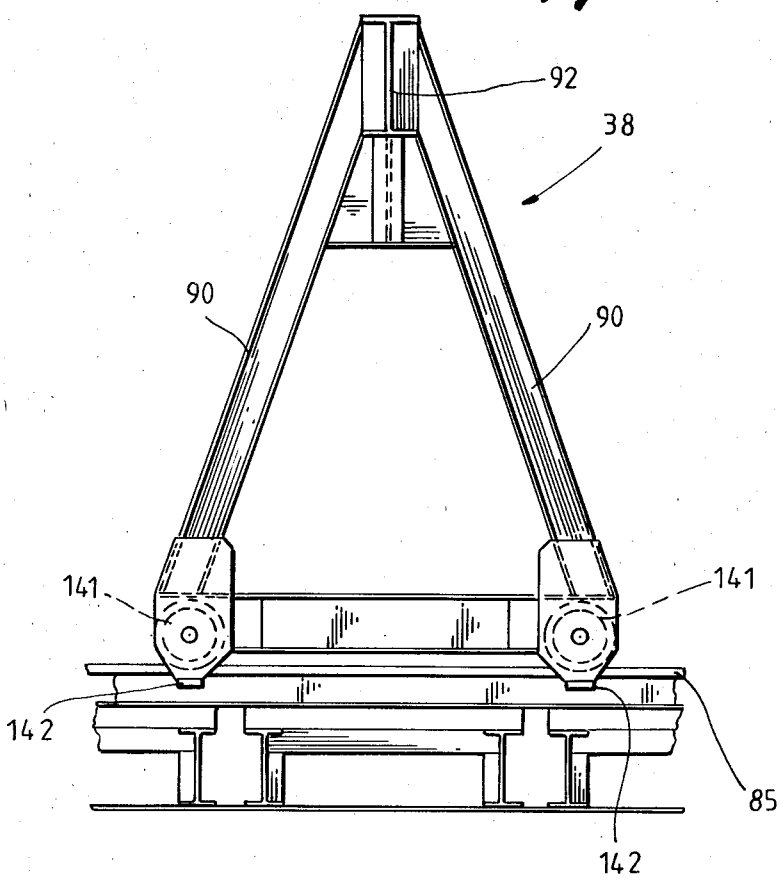
FIG. 17 is an end view of the fixed support means located at the opposite end of the gantry from the support means shown in FIG. 16.
Figure 16:
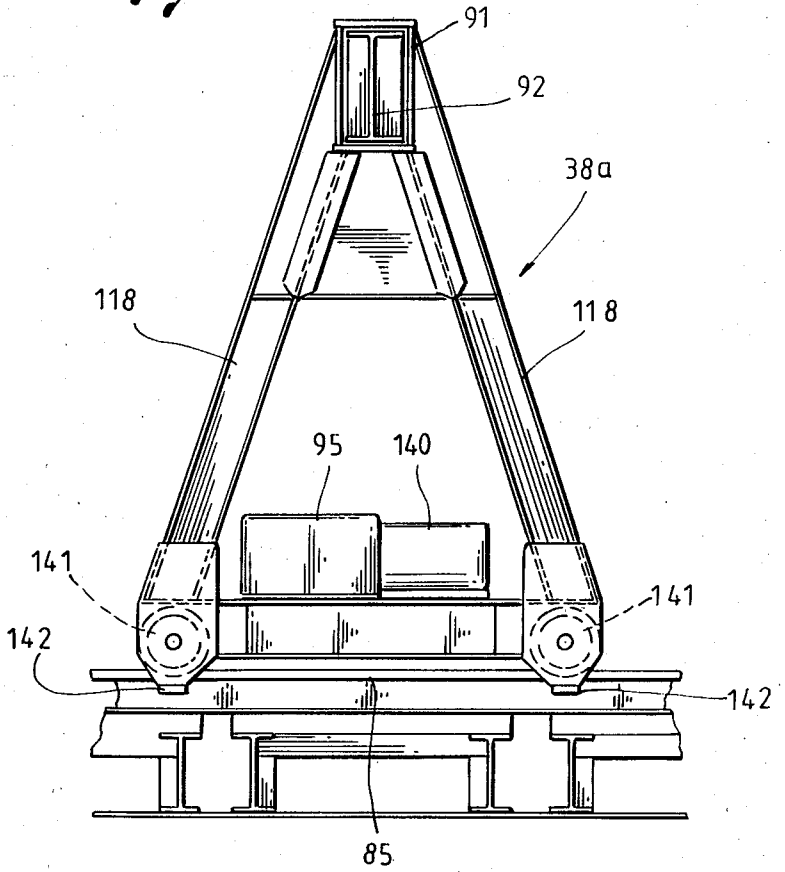
FIG. 16 is an end view of the adjustable support means for the gantry shown in FIG. 15.

FIGS. 15, 16 and 17 illustrate the gantry 3 and support means 38 for the present invention for use on platform or jack-up drilling rigs. Because the position of the drilling floor may move fore and aft with respect to the pipe rack, the gantry 3 must be adjustable to permit the trolley unit 12 to travel further along the gantry 3 as a result of the change in position of the drill floor in order to avoid having to disassemble the unit and move it and the pipe rack over to the drill floor. To avoid the problem of having to disassemble the entire unit when the drill rig floor moves away from the apparatus and pipe rack, the gantry assembly has been designed with one support means **38*a* adjustable from the other support means 38, while at all times maintaining support to the gantry beam 92. FIG. 15** illustrates the operation of the gantry suitable for use in platform drilling operations.

The gantry beam 92 is supported on gantry legs 90 and 118 to form gantry 3. Gantry 3 moves transversely across the pipe rack 87 on rails 85. The gantry 3 follows the transverse movement of the drill floor 19 which also moves on suitable rails (not shown). The trolley unit 12 made up of units 10 and 11 (not shown) moves fore and aft on the gantry beam 92 by means of a rack and pinion drive or other suitable means. The trolley unit 12 follows the fore and aft movement of the drill floor 19, which also moves on rails.

The drill pipes or casings should be set right at the center of the well which is also the center of the rotary and the center of the derrick if a derrick is used, or is the center of the mast if a mast is used.

The apparatus of the present invention, which consists of the trolley unit 12 (not shown in FIG. 15) and the gantry 3 move over the pipe rack 87. The pipes may be stacked over 10 feet high, but the gantry is designed to still pass over the pipe.

When the drill floor moves transversely, the gantry 3 may also be moved transversely by means of motor 98 which drives wheel 141. Movement of wheel 141 propels the gantry 3 along rails 85, and in this way, the lifting mechanism can locate the pipe from the rack and position it at the center of the well. When the drill floor moves fore and aft, the adjustable support means 38*a* and its guide rail 85 may be moved to a different position as shown in FIG. 15 to extend or reduce the length of possible travel of the trolley unit 12 along the gantry beam 92, as required by the new position of the drill floor. Usually, the edge of the drill floor 19 is a distance greater than 5 meters away from the pipe rack 87. The trough 28 is to be extended to allow one end to touch the edge of the drill floor.

The pipe or casings are preferably picked up by the forks 16. They are rotated into the trough 28 as shown in FIGS. 14A–14G to where the pipe is contained inside of the trough 28. The whole trolley assembly 12 is then moved along the gantry beams 92 in the direction of the drill floor. When the trolley assembly 12 reaches the proper location, the trolley stops and the trough frame 15 and trough 28 are moved up or down to the proper elevation and angle. The trough 28 is then extended to reach the drill floor where the pipe or casings or collars can be accessible to the drill rig workers. There, the workers will attach the elevators or other lifting means to the pipe, casings or collars for removal. The trough 28 could also have another means within the trough that will push the pipe further out if needed. This means is not shown, but could be a rack and pinion system within the trough 28 or a hydraulic cylinder arrangement.

Pipes, casings and collars can also be removed from the drill floor. The pipes are lowered into the trough 28 and skidded or if a dolly is available rolled into the trough 28 until the pipes hit the pipe stop 72 (see FIG. 11). The trough 28 is then pulled back away from the drill floor into the trough frame 15. The whole assembly is then moved to the location where the loading arms 14 and forks 16 are on top of the pipes.

The trough 28 and loading arms 14 are then rotated 180° to where the pipes are not resting on the forks 16. The gantry 3 is then moved to the proper location on the pipe rack 85 where the pipes will be deposited by raising the trough 28 and withdrawing the forks 16 by rotating them out of the way or by pulling the gantry 3 away.

Still, referring to FIG. 15, there is shown an elevation of the gantry 3. The gantry 3 has a set of legs 90 and 118, one at each end, that supports the gantry beam 92, which in turn supports the trolley assembly 12 (not shown). The gantry beam 92 will have a rack not shown that will run the length of the beam. At the bottom of each gantry leg is a wheel 141 that allows the gantry to move across the pipe rack 87 on rails 85. The wheel 141 is kept on the rail 85 by locking unit 142. The wheels 141 are driven by electric or hydraulic wheel motors 96 and 98. In some cases, the gantry 3 will be driven by a rack and pinion drive. The purpose for a rack and pinion drive is for a semi-submersible or drill ship where control of the gantry 3 is necessary due to the motion of the vessel in high waves.

Turning now to FIGS. 16 and 17, the gantry 3 is self-contained with an engine 95 and hydraulic pumps or generators 140. These units 140 will be connected to the trolley unit 12 by flexible hoses or cables and held in place by a suitable reel. The engine 95, generator or hydraulic pumps 140, along with the hose reel could also be contained on a suitable skid unit. The power could also come from the drill rig power supply.

The pick-up and lay-down machine 1 of the present invention will be required to move from one drilling rig to another from time-to-time. Often the pipe rack from one rig to another rig will vary in length and width. These differences, however, can be accomodated by the present invention because of the adjustable support means 35*a* and by making rails 85 longer or shorter.

The gantry beam 92 is suitably fixed at the side to support legs 90. Preferably, this is the side nearest the drill floor 86. Connected to support legs 118 is a sliding joint 91 that allows the gantry beam 92 to slide therethrough. When the slip joint 91 slides across the gantry beam 92, the effect is to lengthen or shorten the gantry beam 92 to suit the length of pipe rack and to permit greater or lesser movement of the trolley unit 12. The slip joint 91 can be connected to legs 118 by means of a bracket 139, or some other suitable means.

The movement of the adjustable gantry 38*a* is held from passing the end of the gantry beam 92 by stop 138 which is a piece of steel suitably attached to the top or bottom of gantry beam 92. Slip joint 91 may be moved across gantry beam 92 by means of a motor (not shown), a rack and pinion (not shown), or a suitable hydraulic system (also not shown).

Often, on offshore drill rigs, the elevation of one part of the pipe rack is greater than the elevation of another part of the pipe rack by as much as 10 meters (33 feet), and on some of the newer Arctic type of drill rigs, there is a roof over the pipe rack which makes it impossible for a boom type of a crane to reach the pipe rack. With the roof overhead, it is very difficult to place an overhead crane inside because an overhead crane requires too much space between the roof and the deck below. An overhead crane must have the width of the beam plus the motors below the beam and the pulley below the motor and the hook below the pulley. This takes up about 2 to 3 meters of space. If the roof were elevated the wind load would also increase. Increased wind load increases the likelihood of overturning the drill rig. This leads to more structural steel requirements. The present invention can operate under a lower roof and it can also operate on various deck and pipe levels.

In some instances, a semi-submersible drill rig will have two pipe rack levels, one level on the main deck and the other on the machinery deck. There is a pipe rack on both levels. To take the drill pipe, riser pipes, casings or collars from the pipe rack on the main deck to the pipe rack on the machinery deck, a set of elevator rails is required. The same is true when taking pipe from the lower or machinery level to a higher lay-down level which may or may not be at the same elevation of the main deck.

The gantry 3 will roll or move along rail 85 with riser pipe held in trough 28 and forks 16. The gantry 3 will cross over onto elevator rails. When the entire gantry 3 is on two elevator rails, motors turn pinion gears to lower the entire gantry 164 and pick-up and lay-down machine with riser pipe to the machinery deck level. There, the riser pipe will be deposited on the machinery deck pipe rack. The riser pipe can also be taken off of the machinery deck and placed on the main deck pipe rack in the same manner.

When the riser pipe is required on the drill floor, the pick-up and lay-down machine will pick up the pipe on the machine deck pipe rack in the manner as previously described. The elevator rails raise the gantry 3 and pick-up and lay-down machine to the proper level, called the lay-down level, where the pick-up and lay-down machine will be positioned to set the riser pipe in the drill floor as previously described. Riser pipes, drill pipes, casings and collars can be removed from the drill floor and set on the main deck pipe rack or machinery deck pipe rack in the same but opposite procedure as previously described.

Although the above described embodiment of the present invention has been found to be satisfactory, many variations in structure, machinery, and operation are possible. For example, the motors that drive the pinion gears on the rack gears can have brakes on them that will lock the pinion gears in place if there is a power failure. All other hydraulic systems in the art of pipe handling have hydraulic cylinders that can bleed down during a power failure and cause the pipes to fall off of the machine. Some of the pipes weigh in excess of 30 short tons.

One or more machines can be used on a single drill rig at any time. The machine can be operated by one person on the pipe rack and another person on the drill floor. The operator on the pipe rack has the machine lay down or pick up pipe from the pipe rack. When the pipe is picked up, the pipe rack operator will turn his control to the operator on the drill floor. An automated system can also be built into the machine where all pipes are inventoried, and their location stored in a computer. The pipe will automatically be brought to the drill floor or be taken from the drill floor and set in the proper location in the rack under control of the computer with only one or two human commands. The apparatus of the present invention can also have devices on it that will test the pipe for proper length, for possible flaws in the pipe, and for general condition of the pipe. It can also be made up or equipped with special material for handling exotic pipes. Although the apparatus is shown for offshore use, it can also be adapted for land use; it can also be used to move heavy items on and off of the drill floor or pipe rack; to pick up cargo or other items from supply boats; and can also be used in pipe yards.

Those skilled in the art and familiar with the disclosure of the invention may recognize additions, deletions, substitutions or other modifications which would fall within the purview of the invention as defined in the appended claims.

What is claimed is:

1. A pick-up and lay-down apparatus for transferring tubular pipe from a pipe rack to the drill floor of a drilling rig, comprising:

a gantry extending across and adapted for movement over the pipe rack, said gantry including a gantry cross beam which extends across the pipe rack;

a moveable trolley mounted on said gantry and adapted for movement along said gantry beam; a rotation means;

a pair of moveable spaced apart lifting arms mounted to said trolley by said rotation means, each said spaced apart lifting arm adapted to move independently of the other;

a moveable auxiliary lifting arm mounted on each said spaced apart lifting arm and adapted for independent movement relative to said lifting arm, said gantry and said moveable trolley cooperating to position said lifting arms over a pipe to be transferred;

a fork assembly rotatably mounted to each of said spaced apart lifting arms, said fork rotatable from a first position in which said spaced apart lifting arms may lower said forks below said pipe to be transferred, to a second position in which the forks are extended beneath said pipe to be transferred;

means for rotating said fork assembly; and a trough assembly mounted to said auxiliary lifting arms for movement therewith, said auxiliary lifting arm moving said trough in the direction of said forks to secure said pipe to be transferred between said forks and said trough assembly, said rotation means rotating said spaced apart lifting arms about said gantry from a first position in which said trough assembly is above said pipe to be transferred to a second position in which said pipe to be transferred is resting in said trough assembly, said trough assembly being extensible to supportably move said pipe to be transferred to the drill rig floor.

2. A pick-up and lay-down apparatus for transferring tubular pipe from a pipe rack to the drill floor of a drilling rig, as recited in claim 1, wherein the ends of said lifting arms are adapted to wedge between pipes in the pipe rack and separate said pipes, allowing said lifting arms to move between said pipes.

3. A pick-up and lay-down apparatus for transferring tubular pipe from a pipe rack to the drill floor of a drilling rig, as recited in claim 1, further comprising a lasso hingedly connected at the end of the said trough assembly nearest said drill platform, said lasso capturing the trailing end of said pipe and controlling said pipe's horizontal movement as said pipe is dragged from the trough to the drill floor, said lasso opening to release said pipe after said pipe is positioned over the drill string.

4. A pick-up and lay-down apparatus for transferring tubular pipe from a pipe rack to the drill floor of a drilling rig, as recited in claim 1, wherein said gantry is supported at each end by separate, vertically disposed supports capable of movement laterally relative to the length of said gantry.

5. A pick-up and lay-down apparatus for transferring a length of pipe between a pipe rack and a drill rig, comprising:

a gantry including an elongated gantry beam and two end supports adapted to support said beam alongside and higher than said pipe when in said horizontal position;

a trolley supported from an adapter to run along said beam;

two main lifting arms separately and pivotally supported from said trolley in spaced relation along said beam, said arms being so pivoted to enable the arms to rotate in parallel in vertically disposed planes substantially normal to the length of said beam between a first position in which given corresponding ends of said main arms are at the lowest point in said rotation and a second vertically opposite position;

means for rotating said main lifting arms relative to said trolley;

first drive means between said trolley and each said main arm capable of moving said main arm back and forth along its length independently of said other main arm;

a separate horizontally disposed fork hinged at one end to said given end of each said main arm to pivot between a first position parallel to said beam and a second position pointing toward said pipe in said horizontal position;

means for pivoting said forks relative to each said main arm;

a separate auxiliary arm supported from each said main arm in parallel and movable relation thereto, each said auxiliary arm having a second drive means to enable said auxiliary arm to move lengthwise independently of lengthwise movement of its respective main arm and the other auxiliary arm; and a first elongated trough-like member supported, with its longitudinal axis in a plane parallel to the length of said beam, by two ends of said auxiliary arms corresponding to said given ends of said main arms, the open trough portion of said first trough-like member oriented to face away from the said ends of said auxiliary arms and to cradle a length of pipe parallel to said beam.

6. A pick-up and lay-down apparatus for transferring a length of pipe between a pipe rack and a drill rig, as recited in claim 5, wherein one of said end supports is moveable toward and away from the other said end support and the effective length of said gantry beam is adjustable.

7. A pick-up and lay-down apparatus for transferring a length of pipe between a pipe rack and a drill rig, as recited in claim 5, wherein the gantry is moveable in a direction transverse to the length of said beam.

8. A pick-up and lay-down apparatus for transferring a length of pipe between a pipe rack and a drill rig, as recited in claim 5, further comprising a second horizontal trough-like member supported by said other two ends of said auxiliary arms in a plane parallel to the length of said beam and with the trough-like surface of said second trough-like member parallel and facing opposite the trough-like surface of said first trough-like member.

9. A pick-up and lay-down apparatus for transferring a length of pipe between a pipe rack and a drill rig, as recited in claim 5, wherein said trough member is extendable in length.

10. A pick-up and lay-down apparatus for transferring tubular pipe between a horizontal pipe rack and a drill rig floor, comprising:

a gantry having vertically disposed supports and a horizontal beam, adapted for movement over a pipe rack;

a pair of separate spaced apart lifting arms rotatably mounted to said gantry and adapted for movement along said gantry beam, each said lifting arm comprising a main arm portion and a parallel auxiliary arm portion, each main arm and auxiliary arm having independent drive means to enable said main arm and said auxiliary arm to move independently along their respective lengths;

a trough mounted to corresponding ends of said auxiliary arms for vertical movement therewith, a pipe securing means for holding said pipe in said trough, said auxiliary arms in unison moving said trough downwardly to secure said pipe in said trough prior to rotation and after rotation independently moving upwardly to lift said pipe cradled in said trough towards the drill rig floor; and arm rotation means for rotating said arms and trough from a first position with the trough above said pipe to a second position with the trough below said pipe.

11. A pick-up and lay-down apparatus for transferring tubular pipe between a horizontal pipe rack and a drill rig floor, as recited in claim 10, wherein said pipe securing means is a separate horizontally disposed fork hinged at one end to one of two corresponding ends of said main arms to rotate between a first position parallel to the length of said gantry and a second position perpendicular to said first position.

12. A pick-up and lay-down apparatus for transferring tubular pipe between a horizontal pipe rack and a drill rig floor, as recited in claim 11 wherein:

each end of said main arms has a separate horizontally disposed fork hinged to rotate between a first position parallel to the length of said gantry and a second position perpendicular to said first position; and a second trough is mounted to corresponding opposite ends of said auxiliary arms for movement therewith.

13. A pick-up and lay-down apparatus for transferring tubular pipe between a horizontal pipe rack and a drill rig floor, as recited in claim 10, further comprising a trough extension means for extending said trough from alongside said gantry towards said drill rig floor.

14. A pick-up and lay-down apparatus for transferring pipe from a horizontal storage position to a drill rig floor, as recited in claim 11, wherein said trough extension means comprises a meter which turns a gear upon a rack connected to said trough which moves said trough from a position alongside said gantry to a position extending from the side of said gantry toward said drill rig floor.

15. A pick-up and lay-down apparatus for transferring pipe between a horizontal pipe rack and a drill rig floor, as recited in claim 10, wherein one of said supports is moveable toward and away from the other said support and the effective length of said gantry beam is adjustable.

16. A pick-up and lay-down apparatus for transferring tubular pipe between a horizontal pipe rack and a drill rig floor, as recited in claim 10, wherein the gantry is moveable in a direction transverse to the length of said beam.

17. A pick-up and lay-down apparatus for transferring tubular pipe between a pipe rack and the drill floor of a drilling rig, as recited in claim 10, further comprising a lasso hingedly connected at the end of the said trough assembly nearest said drill platform, said lasso capturing the trailing end of said pipe and controlling said pipe's horizontal movement as said pipe is dragged from the trough to the drill floor, said lasso opening to release said pipe after said pipe is positioned over the drill string.

* * * * *

UNITED STATES PATENT AND TRADEMARK OFFICE

CERTIFICATE OF CORRECTION

PATENT NO. : 4,552,498

DATED : November 12, 1985

INVENTOR(S) : Edward D. Dysarz

It is certified that error appears in the above—identified patent and that said Letters Patent is hereby corrected as shown below:

Column 14, line 43, delete "meter" and insert --motor--.

Signed and Sealed this

*Twentieth* Day of *May 1986*

[SEAL]

*Attest:*

DONALD J. QUIGG

*Attesting Officer*

*Commissioner of Patents and Trademarks*